US012454865B1

(12) United States Patent
Richards

(10) Patent No.: US 12,454,865 B1
(45) Date of Patent: Oct. 28, 2025

(54) VALVE SYSTEM FOR SELECTIVE CONTROL OF DRILLING FLUID FLOW

(71) Applicant: Schlumberger Technology Corporation, Sugar Land, TX (US)

(72) Inventor: Edward Richards, Cheltenham (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/883,598

(22) Filed: Sep. 12, 2024

(51) Int. Cl.
*E21B 7/06* (2006.01)
*E21B 21/10* (2006.01)

(52) U.S. Cl.
CPC ..... *E21B 7/065* (2013.01); *E21B 7/06* (2013.01); *E21B 21/10* (2013.01)

(58) Field of Classification Search
CPC . E21B 21/10; E21B 34/10; E21B 7/06; E21B 7/064; E21B 7/065
See application file for complete search history.

(56) References Cited

U.S. PATENT DOCUMENTS

| | | | | |
|---|---|---|---|---|
| 3,488,765 | A * | 1/1970 | Anderson | E21B 21/10 175/61 |
| 4,637,479 | A * | 1/1987 | Leising | E21B 7/065 175/45 |
| 8,544,567 | B2 * | 10/2013 | Comeau | E21B 10/602 239/487 |
| 10,947,814 | B2 | 3/2021 | Parkin et al. | |
| 11,566,481 | B2 * | 1/2023 | Chambers | E21B 7/06 |
| 2007/0221409 | A1 * | 9/2007 | Hall | E21B 4/14 175/73 |
| 2015/0107902 | A1 * | 4/2015 | Downton | E21B 23/04 175/45 |
| 2020/0063526 | A1 * | 2/2020 | Parkin | E21B 7/062 |
| 2020/0325731 | A1 * | 10/2020 | Chambers | E21B 7/068 |
| 2020/0392839 | A1 * | 12/2020 | Dwars | E21B 21/12 |
| 2021/0164292 | A1 * | 6/2021 | Deolalikar | E21B 7/062 |
| 2021/0324682 | A1 * | 10/2021 | Chambers | E21B 7/06 |
| 2024/0159109 | A1 * | 5/2024 | Peters | E21B 7/06 |

FOREIGN PATENT DOCUMENTS

| | | | |
|---|---|---|---|
| GB | 2605358 | A | 10/2022 |
| WO | 2019083622 | A1 | 5/2019 |

OTHER PUBLICATIONS

The SABER Tool, Rotary Steerable System, Enteq Technologies, https://www.enteq.com/products/rotary-steerable-system-srss/, 5 pages.

* cited by examiner

*Primary Examiner* — Robert E Fuller
(74) *Attorney, Agent, or Firm* — Jeffrey D. Frantz

(57) ABSTRACT

A downhole tool for forming a wellbore includes a plurality of jets configured to flow a main flow of a flow of drilling fluid out of the downhole tool along a main flow path. The downhole tool includes a plurality of main valves in fluid communication with the plurality of jets along the main flow path and being actuatable to control the main flow through the plurality of jets. The downhole tool further includes a control valve in fluid communication with the plurality of main valves along a control flow path and configured to direct the control flow selectively to the plurality of main valves to selectively actuate the plurality of main valves based on a selective mechanical input to the control valve. The downhole tool further includes a mechanical input mechanism for providing the selective mechanical input to the control valve.

20 Claims, 9 Drawing Sheets

VALVE SYSTEM FOR SELECTIVE CONTROL OF DRILLING FLUID FLOW

BACKGROUND OF THE DISCLOSURE

Wellbores may be drilled into a surface location or seabed for a variety of exploratory or extraction purposes. For example, a wellbore may be drilled to access fluids, such as liquid and gaseous hydrocarbons, stored in subterranean formations and to extract the fluids from the formations. Wellbores used to produce or extract fluids may be formed in earthen formations using earth-boring tools such as drill bits for drilling wellbores and reamers for enlarging the diameters of wellbores.

Downhole tools may be implemented to form wellbores which may facilitate the flow of drilling fluid to, through, and out of the downhole tool, such as to cool cutting surfaces of the downhole tool and to remove cuttings. A valve system is described herein for leveraging the flow of drilling fluid in the downhole tool to facilitate steering the downhole tool based on selectively directing the flow of the drilling fluid through select jets and to select parts of the downhole tool.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIG. 2-1 is a schematic illustration of a downhole tool, according to at least one embodiment of the present disclosure;

FIG. 2-2 is a schematic illustration of the downhole tool of FIG. 2-1 with a valve system implemented therein for controlling the flow of drilling fluid through jets, according to at least one embodiment of the present disclosure;

FIGS. 3-1 and 3-2 illustrate example implementations of a valve system for achieving a steering effect of a downhole tool, according to at least one embodiment of the present disclosure;

FIG. 6-1 is a flow diagram of a valve system for selectively directing a flow of drilling fluid, according to at least one embodiment of the present disclosure;

FIG. 6-2 is a flow diagram of a valve system for selectively directing a flow of drilling fluid, according to at least one embodiment of the present disclosure.

DETAILED DESCRIPTION

A valve system is described herein for controlling and directing the flow of drilling fluid in a downhole tool. The valve system includes a control valve and a plurality of main valves. The control valve operates based on a control flow of the drilling fluid for providing selective actuation of the main valves. Based on one or more main valves being actuated, a main flow of the drilling fluid flows through the actuated main valves to associated jets located on a downhole end of the downhole tool. The drilling fluid may accordingly be made to selectively and alternatingly flow from the various jets of the downhole tool. In this way, the control valve may be advantageously implemented to handle or interface with only a small portion of the flow of drilling fluid for providing several, selective control flow outputs to the main valves, which are better equipped for directing the bulk of the drilling fluid to the jets.

The selective flow of the drilling fluid may cause the downhole tool to steer in a certain direction. For example, based on an increased flow, and more specifically based on an increased velocity, of the drilling fluid flowing through the selectively activated jets, the downhole tool may be drawn or urged in a given direction due to the lower pressure of the higher-velocity drilling fluid. In this way, the downhole tool may be steered by leveraging the differential flow dynamics of the drilling fluid flowing along the downhole tool.

The downhole tool may also be equipped with several actuatable or extendable steering elements, such as those known in point-the-bit and push-the-bit-steering systems. The actuatable steering elements may be operated based on providing a hydraulic fluid, such as the drilling fluid, to the steering elements. The valve system may be implemented to operate the actuatable steering elements in conjunction with selectively flowing the drilling fluid from the jets. For example, one or more steering elements may be actuated in conjunction with a main valve to both extend the steering element and flow the drilling fluid through associated jets. The steering element and the main valve may both be actuated based on a same control flow provided from the control valve, for example, in parallel. In another example, one or more steering elements may be actuated in conjunction with the drilling fluid flowing through one or more jets. The steering element and the one or more jets may both be operated based on a same main flow provided from the main valve, for example, in parallel. In this way, the valve system may facilitate steering the downhole tool based on operating these two different steering means in conjunction.

Figure 1:
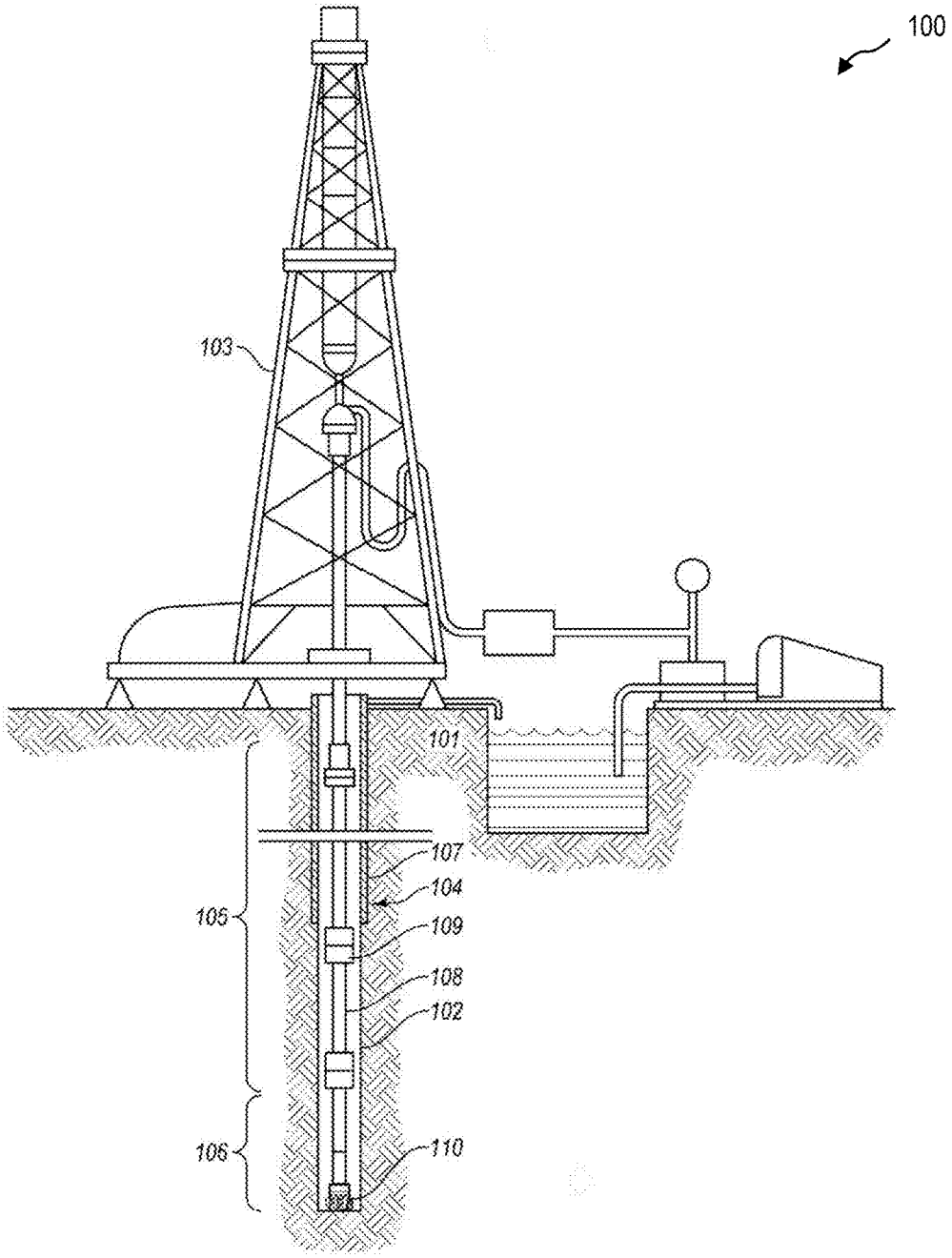
FIG. 1 is an example of a downhole system, according to at least one embodiment of the present disclosure.

Additional details will now be provided regarding systems described herein in relation to illustrative figures portraying example implementations. For example, FIG. 1 shows one example of a downhole system 100 for drilling an earth formation 101 to form a wellbore 102. The downhole system 100 includes a drill rig 103 used to turn a drilling tool assembly 104 which extends downward into the wellbore 102. The drilling tool assembly 104 may include a drill string 105, a bottomhole assembly ("BHA") 106, and a bit 110, attached to the downhole end of the drill string 105.

The drill string 105 may include several joints of drill pipe 108 connected end-to-end through tool joints 109. The drill string 105 transmits drilling fluid through a central bore and transmits rotational power from the drill rig 103 to the BHA 106. In some embodiments, the drill string 105 further includes additional downhole drilling tools and/or components such as subs, pup joints, etc. The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, and for lifting cuttings out of the wellbore 102 as it is being drilled.

As described herein, the drilling fluid discharging from the bit may adjust a direction, steering, or trajectory of the bit. Accordingly, the bit, BHA, and/or other components may include a valve system for controlling the flow of the drilling fluid selectively through the nozzles, jets, or other orifices. The valve system may be implemented to selectively actuate steering pads or other engagement pads of the BHA, for example, in conjunction with selectively controlling the flow of the drilling fluid from the bit.

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits. In other embodiments, the bit 110 may be a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to the surface or may be allowed to fall downhole. The bit 110 may include one or more cutting elements for degrading the earth formation 101.

The BHA 106 may be or may include a rotary steerable system (RSS) or other similar components. The RSS may include directional drilling tools that change a direction of the bit 110, and thereby the trajectory of the wellbore. At least a portion of the RSS may maintain a geostationary position relative to an absolute reference frame, such as one or more of gravity, magnetic north, or true north. Using measurements obtained with the geostationary position, the RSS may locate the bit 110, change the course of the bit 110, and direct the directional drilling tools on a projected trajectory. The RSS may steer the bit 110 in accordance with or based on a trajectory for the bit 110. For example, a trajectory may be determined for directing the bit 110 toward one or more subterranean targets such as an oil or gas reservoir.

Figures 1, 2:
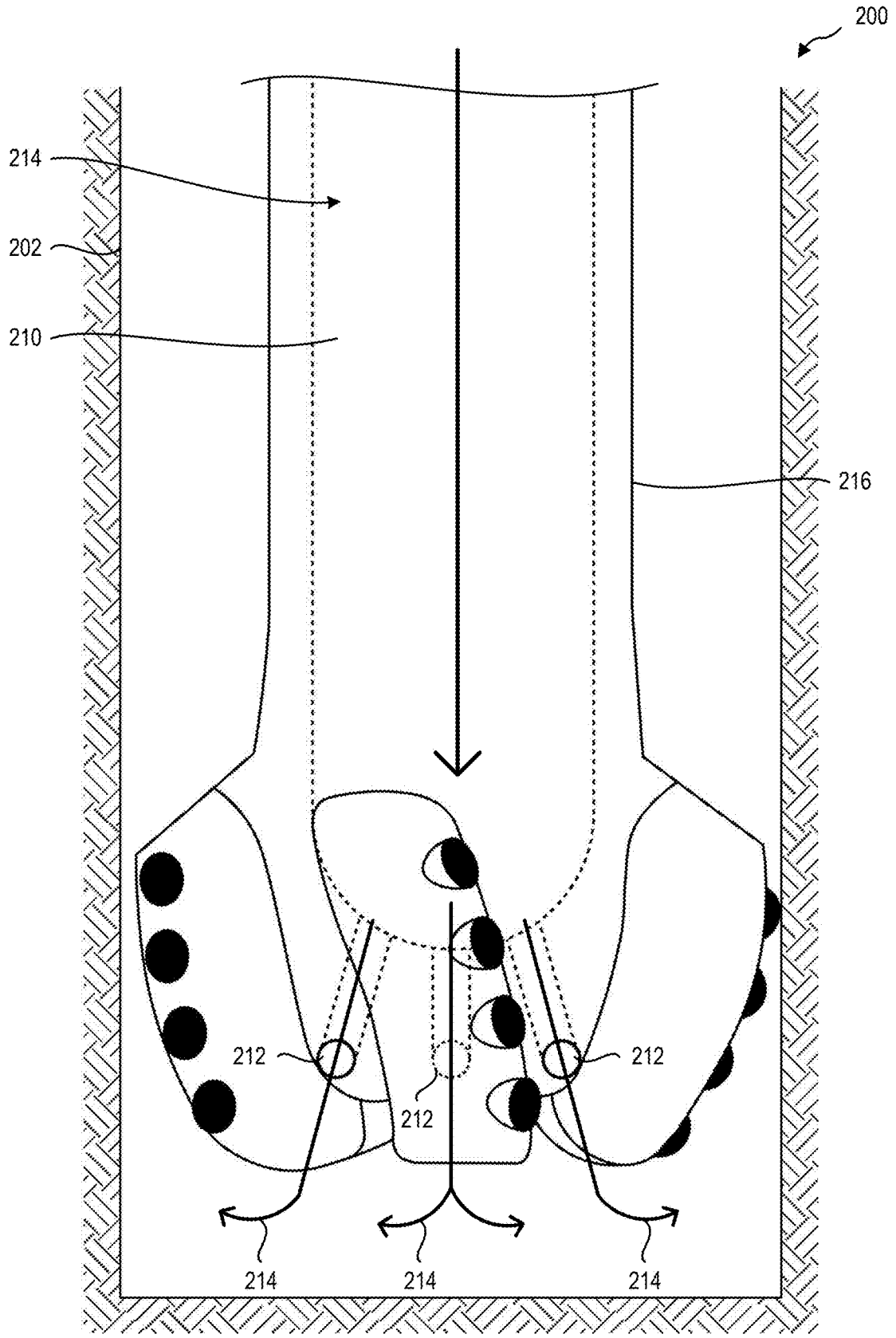
Figure 2:
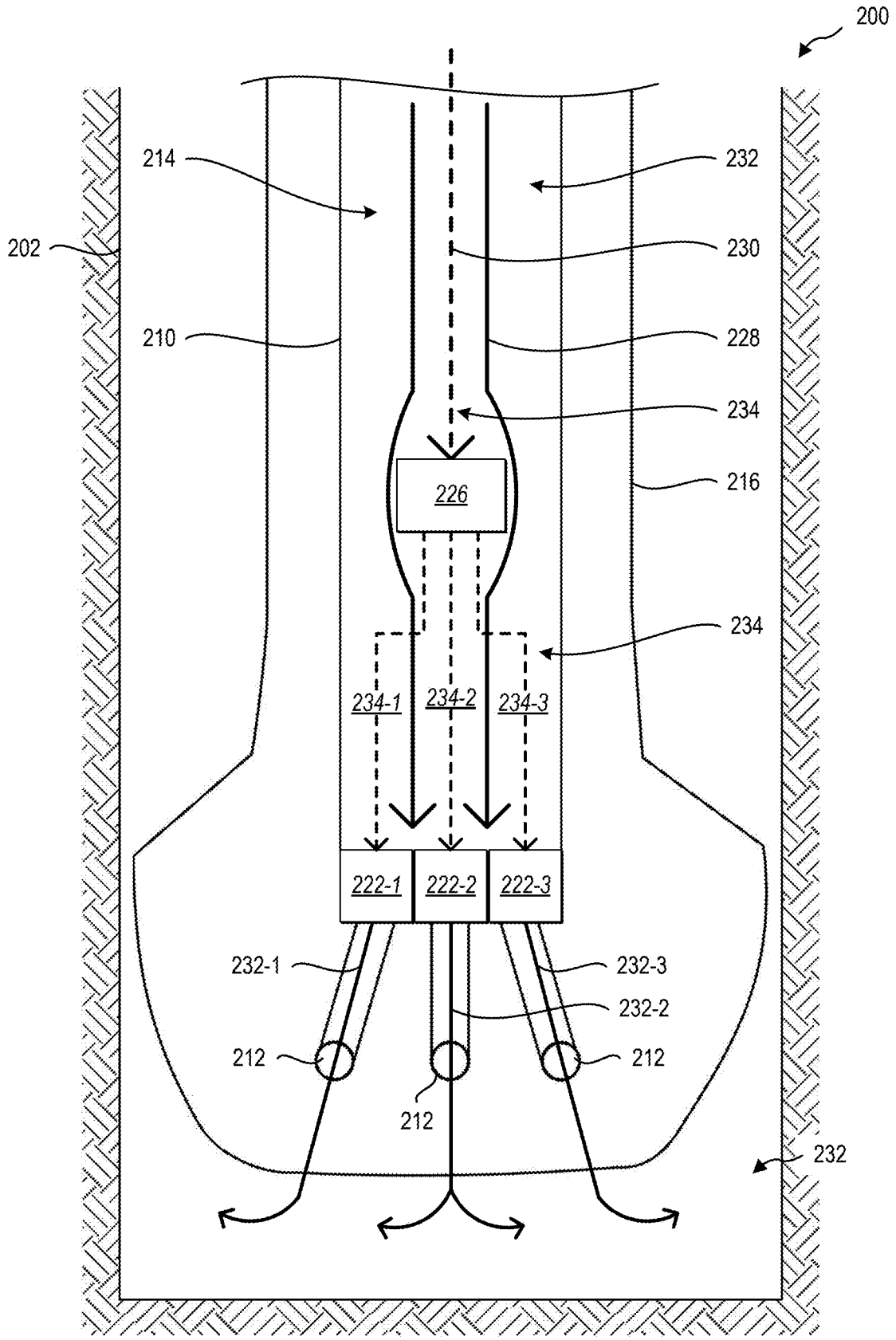

FIG. 2-1 is a schematic illustration of a downhole tool 200, according to at least one embodiment of the present disclosure. The downhole tool 200 may be a bit, may be part of a BHA, or may otherwise be included in another downhole component. The downhole tool 200 may be implemented in a wellbore 202, for example, to drill or form the wellbore 202.

The downhole tool 200 may include a hydraulic passage 210 through which a flow of drilling fluid 214 may be provided, for example, from the surface. For instance, a supply of drilling fluid may be pumped or otherwise caused to flow from the surface, through several joints of drill pipe and/or other downhole components, and to the downhole tool 200 via the hydraulic passage 210.

The downhole tool 200 may include one or more jets 212. The jets 212 may be jets, nozzles, apertures, or other orifices through which the drilling fluid may flow. For example, the jets 212 may be in fluid communication with the hydraulic passage 210, and the flow of the drilling fluid 214 may flow from the hydraulic passage 210 and out of the downhole tool 200 through the jets 212. The jets 212 may flow the drilling fluid from the downhole tool 200 in this way to cool the downhole tool 200, to clean or clear cuttings or other matter from the downhole tool 200, and/or to carry away cuttings from the bottom of the wellbore 202. In some embodiments, the jets 212 may be positioned on a downhole end of the downhole tool 200. For example, the jets 212 may be positioned on a downhole end of a bit, such as on one or more blades of the bit, in one or more channels between blades of the bit, near or adjacent a cutting or engagement element of the bit, or at any other location of the bit. The jets 212 may be positioned at any other location of the downhole tool, such as on a body 216 of the downhole tool.

In some embodiments, the jets 212 may be connected to the hydraulic passage 210 such that the flow of drilling fluid 214 flows freely, passively, or directly from the hydraulic passage 210, to the jets 212, and out of the downhole tool 200. For example, the jets 212 may be connected directly to the hydraulic passage 210 such that any fluid that flows through and/or down the hydraulic passage 210 may substantially flow out one or more (or all) of the jets 212.

In various cases, it may be advantageous to selectively control the manner in which the flow of drilling fluid 214 flows through the jets 212, such as by controlling how much of the flow of drilling fluid 214 flows through the jets, through which and how many jets the drilling fluid 214 flows, a timing or frequency with which the flow of drilling fluid 214 flows through the jets 212, and combinations thereof.

FIG. 2-2 is a schematic illustration of the downhole tool 200 with a valve system implemented therein for controlling the flow of drilling fluid 214 through the jets 212, according to at least one embodiment of the present disclosure. The valve system includes one or more main valves (collectively 222) for controlling the flow of drilling fluid 214 through the jets 212, and a control valve 226 for controlling the main valves 222.

In some embodiments, the valve system includes a first main valve 222-1, a second main valve 222-2, and a third main valve 222-3. The valve system may include any number of main valves 222, including a singular main valve 222. The main valves 222 may each correspond to one jet 212 or may correspond with several jets 212. The main valves 222 may control the flow of the drilling fluid 214 to the jets 212 to which each main valve 222 corresponds. For example, the main valves 222 may connect to the jets 212 through one or more channels or passages in the downhole tool 200 such that the main valves 222 are in fluid communication with the jets 212. The main valves 222 may also be in fluid communication with the hydraulic passage 210 such that the main valves may receive the flow of drilling fluid 214 from the hydraulic passage 210 (e.g., the main flow as described herein). For example, the main valves 222 may be positioned in the hydraulic passage 210, may be connected to the hydraulic passage 210 through one or more additional passages, channels pipes, etc., or may otherwise be positioned fluidly between the hydraulic passage 210 and the jets 212. In this way, the main valves 222 may be actuated or controlled to control the flow of the drilling fluid 214 to the jets 212. The main valves 222 may be selectively and/or independently activated or actuated as described herein in order to selectively allow the flow of drilling fluid 214 to flow out of select jets.

In some embodiments, the main valves 222 may be valves of a type that are suited for handling high pressures and/or flow rates. For example, the main valves may be shuttle valves. The main valves may be iris valves, poppet valves, or any other type of valve. In some embodiments, the main valves may be 2-way valves. In some embodiments, the main valves may be modulating valves that may modulate or control a magnitude of the flow of the drilling fluid 214 through the main valves 222. The main valves 222 may all be the same type of valve, or may be different types of valves. The main valves 222 may be configured to handle high fluid pressures of the flow of drilling fluid 214, such as up to 750 psi or up to 1000 psi. The main valves 222 may also be configured to handle flow rates of the flow of drilling fluid 214 of up to 300 gallons per minute (gpm), 800 gpm, 1000 gpm, 1500 gm, 2000 gpm, or any value therebetween.

As mentioned, the valve system includes a control valve 226. The control valve 226 may be a valve with several selectable outputs for selectively flowing drilling fluid (e.g., a control flow as described herein) to one or more main valves 222 to selectively actuate the main valves 222. For example, the control valve 226 may be a rotary valve with a rotor that may be selectively positioned to allow fluid to flow to one or more ports of the control valve 226 to provide one or more outputs of the control valve 226. The valve system may be configured with a selective mechanical input mechanism for controlling the actuation of the control valve 226. For example, the control valve 226 may be coupled to a roll-stabilize platform of the downhole tool for actuating the (e.g., rotary) control valve 226 based on selective rotations of the downhole tool. In some embodiments, the control valve 226 may include or may be associated with a motor, such as a servo motor for controlling the actuation of the control valve 226. The valve system may include any other device or mechanism for providing a mechanical input to the control valve 226 and for selectively actuating the control valve 226 to provide the various outputs (and combinations of outputs) of the control valve 226 to the main valves 222.

In some embodiments, the flow of drilling fluid 214 may include a main flow 228 and a control flow 230. The main flow 228 may be a portion of the flow of drilling fluid 214 that flows to and/or through the main valves 222 and the jets 212. The control flow 230 may be a portion of the flow of drilling fluid 214 that flows to the control valve 226 and through the control valve 226 to the main valves 222 to selectively control the main valves 222 as described herein. The main flow 228 may be larger than the control flow 230, such as having a larger volume or volumetric flow rate. For example, the main flow 228 may be 5, 10, 15, 20, 50, or 100 times larger than the control flow 230. The main flow 228 and the control flow 230 may exhibit the same fluid pressure.

In some embodiments, the main flow 228 may follow a main flow path 232 and the control flow may follow a control flow path 234. For example, the main flow 228 and the control flow 230 may flow together (e.g., as the flow of drilling fluid 214) through the various uphole components and to the downhole tool 200 as a single, same flow. The main flow 228 and the control flow 230 may be separated within the downhole tool 200 to flow along the main flow path 232 and the control flow path 234, respectively. For example, the control valve 226 may be positioned in the hydraulic passage 210 and may receive or permit a portion of the flow of drilling fluid 214 to flow through the control valve 226 and to one or more outputs of the control valve 226 as the control flow 230. In some embodiments, the control flow 230 may be created by otherwise diverting a portion of the flow of drilling fluid 214 to the control valve 226, such as through one or more channels, passages, or pipes. In some embodiments, the main flow 228 may be the remainder of the flow of the drilling fluid 214 that is not diverted for the control flow 230.

The control valve 226 may control the main valves 222 by directing or diverting the control flow 230 to one or more of the main valves 222. For example, the control valve 226 may be in fluid communication with the main valves 222 through the control flow path 234. The control flow path 234 may include individual control flow paths for each of the associated main valves. For example, the control flow path 234 may include a first control flow path 234-1, a second control flow path 234-2, and a third control flow path 234-3 (collectively the control flow path 234) connecting the control valve 226 to the first main valve 222-1, the second main valve 222-2, and the third main valve 222-3, respectively. The control valve 226 may be connected to each of the main valves 222 through one or more passages, channels, or pipes defining the respective control flow paths.

The control valve 226 may selectively control the main valves 222 by selectively flowing the control flow 230 to one or more of the main valves 222. For example, the main valves 222 may be actuatable based on receiving the control flow 230, for example, as a control signal. The control flow 230 may hydraulically actuate, activate, open (e.g., in a normally closed main valve), or close (e.g., in a normally open main valve) a main valve to control the main flow 228 through that main valve.

The control valve 226 may selectively control the main valves 222 in this way in that the control valve 226 may independently actuate any of the main valves 222, including combinations of main valves 222. For example, the control valve 226 may be implemented to actuate a single main valve 222 at a time, may actuate all of the main valves 222 at the same time, and/or may actuate a subset of all of the main valves 222 at a time. The control valve 226 may selectively actuate any of the main valves 222 at any time, in any sequence, and for any duration. In this way, the control valve 226 may (e.g., indirectly) control the flow of drilling fluid 214 to the jets 212 in an independent and selective manner via the main valves 222 by leveraging a small portion of the flow of drilling fluid 214 rather than, for example, controlling or diverting all of the flow of drilling fluid 214 to the jets 212 with the control valve 226.

Based on the selective controlling of the main valves 222 by the control valve 226, the main valves 222 may direct the main flow 228 to the jets 212 and out of the downhole tool 200. For example, the main flow 228 may flow through the hydraulic passage 210 along the main flow path 232 and to the main valves 222. Based on the selective actuation of one or more of the main valves 222, the main flow 228 may continue along through one or more of the main valves 222 along the main flow path 232, to one or more of the jets 212 and out of the downhole tool 200. For instance, the main flow path 232 may include a plurality of main flow paths, such as a first main flow path 232-1, a second main flow path 232-2, and a third main flow path 232-3, connecting the first main valve 222-1, the second main valve 222-2, and the third main valve 222-3 to the corresponding jets 212, respectively.

In this way, drilling fluid may be selectively controlled to flow out of select jets based on a two-tiered valve structure of the valve system. The two-tiered valve structure may be advantageous in that the control valve 226 may designate and control the main flow 228, but may not directly handle, interface with, or otherwise direct the main flow 228. For example, the main valves 222 may be utilized to direct the main flow 228 based on the main valves 222 being better equipped to handle high flow rates at the high fluid pressures of the drilling fluid. However, the main valves 222 may not be configured for selective actuation to multiple, independent sets of jets 212 (e.g., multiple selective outputs). The control valve 226, however, may be selectively actuatable to provide control flows for multiple, independent outputs, but may not be equipped to do so at the scale and magnitude of the fluid pressure and/or flow rates of the larger, main flow 228. In this way, different valves may be utilized at the different tiers of the valve system which may perform better for their specialized tasks.

For example, some conventional devices may selectively control the output of the main flow 228 to select jets 212 based on a single control valve such as a single rotary valve. For example, the rotary valve may receive the (e.g., entire) flow of the drilling fluid and may be selectively actuated to provide the flow of the drilling fluid selectively to different jets. Thus, some conventional techniques may utilize a single, rotary valve in place of the several valves and several tiers of the valve system. A limitation resulting from such a technique, however, is that such a multi-output rotary valve must be larger than, for example, the control valve 226 of the valve system in order to accommodate and sufficiently direct the entire flow of the drilling fluid to the jets, as opposed to only handling a smaller, control flow. The high pressures of the drilling fluid, such as up to 750 psi or up to 1000 psi, when acting on a larger rotary valve having a rotor with a larger surface area results in much larger axial friction forces acting on the rotor of the rotary valve. This is compounded by the fact that, in addition to larger axial forces resulting from a larger surface area upon which the fluid pressure will act, the rotor of the rotary valve will necessarily have a larger diameter, and thus the axial forces will act on the rotor with larger moment arms, requiring considerably more torque to turn the rotor. Thus, a considerably more powerful mechanical input device may be required to produce the larger forces and torques needed to selectively actuate the rotary valve.

The valve system may overcome these limitations based on implementing the smaller, control valve 226. For example, because the control valve 226 will not handle the full flow of drilling fluid 214 and instead only acts on the much smaller, control flow 230, the control valve 226 can be implemented as a much smaller (e.g., rotary valve). Thus, given the same fluid pressure, the forces and torques acting on the control valve 226 are considerably smaller, and accordingly the mechanical force and/or torque input for actuating the control valve 226 may also be considerably smaller. Thus, the valve system may provide multiple, selective outputs at the control valves 226 for the high pressure and high flow rates of the flow of drilling fluid 214 with advantageously smaller input forces and torques for actuating the control valve 226.

Figures 1, 3:
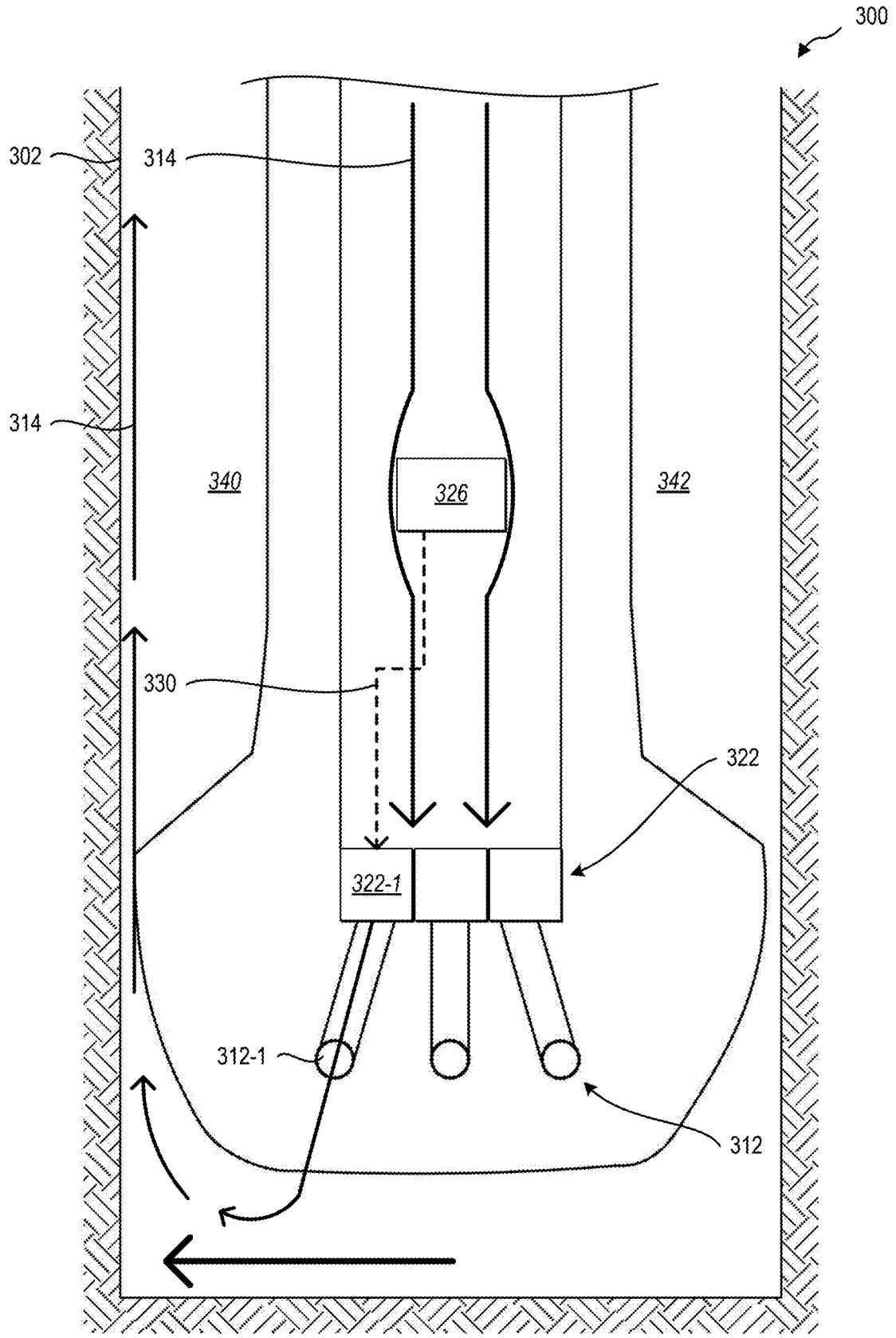
Figures 2, 3:
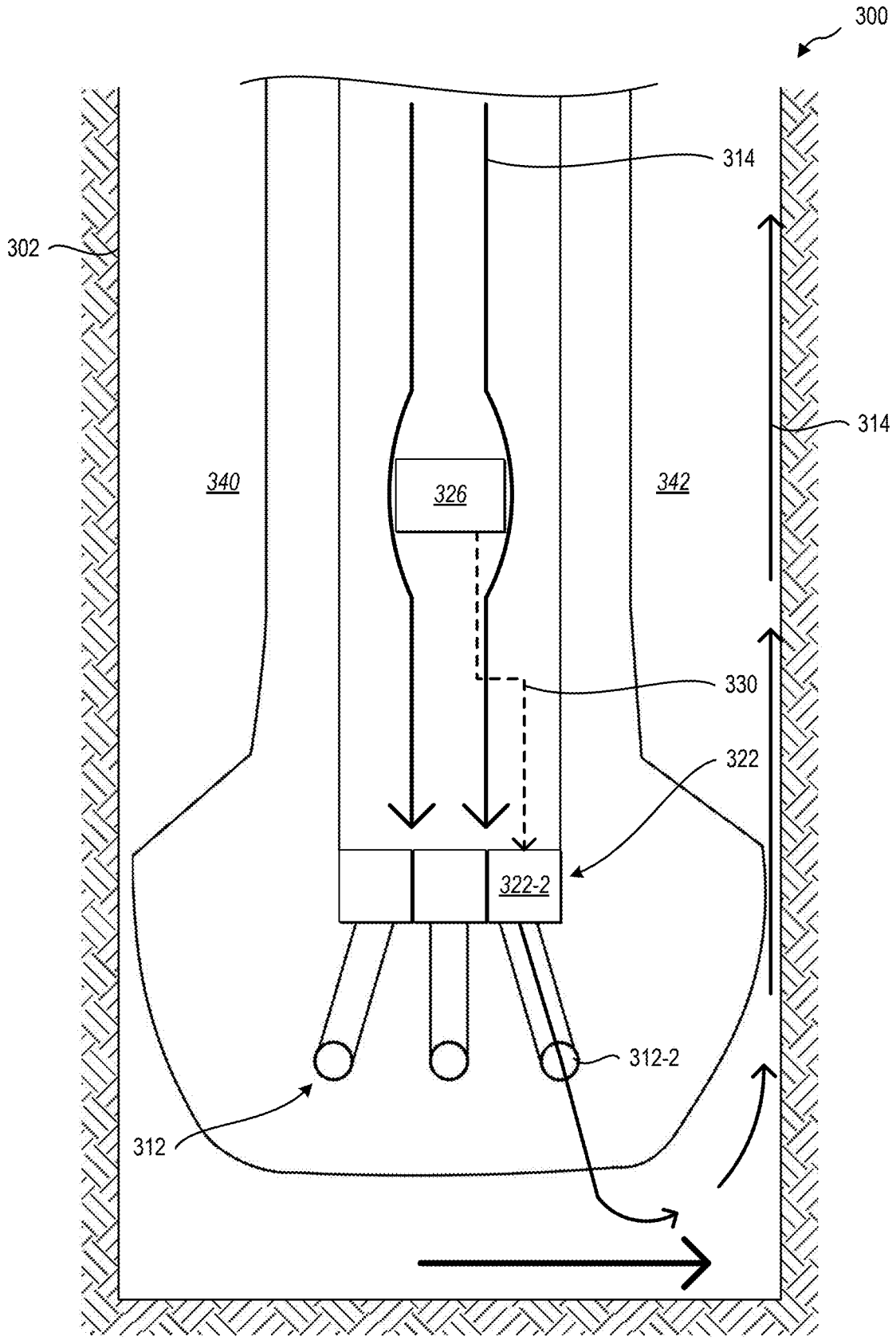

FIGS. 3-1 and 3-2 illustrate example implementations of a valve system for achieving a steering effect of a downhole tool 300, according to at least one embodiment of the present disclosure. The valve system includes a control valve 326 operatively coupled to a plurality of main valves 322. The main valves 322 are connected to a plurality of jets 312 for selectively directing a flow of drilling fluid 314 out of the downhole tool 300 via the jets 312 as described herein.

In some embodiments, the selective flowing of the drilling fluid through the jets may cause or facilitate a steering effect of the downhole tool 300. For example, as shown in FIG. 3-1, the control valve 326 may selectively actuate a first main valve 322-1 based on providing a control flow 330 to the first main valve 322-1 as described herein. The first main valve 322-1 may accordingly direct the flow of drilling fluid 314 to and through a first jet 312-1. The first jet 312-1 may be positioned, directed, and/or associated with a first side 340 of the downhole tool 300. Accordingly, the drilling fluid 314 may flow out of the downhole tool 300 via the first jet 312-1 on the first side 340 of the downhole tool, and may flow upward through the wellbore 302 along the first side 340 of the downhole tool 300. The selective actuation of the first main valve 322-1 may cause the flow of the drilling fluid from the first jet 312-1 at and along the first side of the downhole tool 300 to be of a higher velocity than drilling fluid present or flowing at one or more other locations along the downhole tool 300. Based on Bernoulli's principle, the faster flow and corresponding lower pressure of the flow of drilling fluid 314 along the first side 340 of the downhole tool 300 may produce a net force acting on the downhole tool in the direction of the first side 340. For example, the lower pressure resulting from the faster flow of the drilling fluid 314 along the first side 340 of the downhole tool 300 may suck or draw the downhole tool 300 in the direction of the first side 340. In this way, the downhole tool 300 may be steered or directed based on the differential flow dynamics of the drilling fluid 314 at and along an outer portion of the downhole tool 300.

Similarly, as shown in FIG. 3-2, the control valve 326 may selectively actuate a second main valve 322-2 based on providing the control flow 330 to the second main valve 322-2 as described herein. The second main valve 322-2 may accordingly direct the flow of drilling fluid 314 to and through a second jet 312-2 at a second side 342 of the downhole tool 300. Based on the drilling fluid 314 flowing out of and along the downhole tool 300 at the second side 342, the downhole tool 300 may be steered or directed toward the second side 342.

Any number of jets 312 (and corresponding main valves 322) may be included and positioned on the downhole tool 300 for directing the drilling fluid 314 to steer the downhole tool 300 in any number of corresponding directions. In some embodiments, each of the control valves 326 and corresponding jets 312 may be activated periodically in time with the rotation of the downhole tool such that each jet flows the drilling fluid 314 out of and along a corresponding side of the downhole tool 300 as that corresponding side arrives at and rotates through a given reference point or angle of the wellbore 302. For example, it may be desirable to steer the downhole tool 300 in a direction of a given global azimuth. The downhole tool 300 may rotate, and as each jet approaches and/or passes through an angular position corresponding with the given azimuth, the valve system 320 may cause the drilling fluid 314 to flow through the jet and along a corresponding side of the downhole tool 300 in order to direct the downhole tool 300 as described herein in the direction of the given azimuth. In this way, the valve system may leverage the flow of the drilling fluid 314 to direct or steer the downhole tool 300 as it rotates.

It should be understood that the drilling fluid 314 being shown and described as flowing out of a specific jet or jets is meant to depict a bias of the drilling fluid 314 flowing out of the downhole tool through those select jets. For example, while in some embodiments the valve system may be implemented to only flow the drilling fluid 314 through one or more jets, for example, without flowing the drilling fluid 314 through one or more other jets, in other embodiments, the valve system may flow the drilling fluid 314 through the select jets to a greater degree or at a greater flowrate or velocity than one or more other jets, while still flowing some of the drilling fluid 314 through those other jets. In this way at least some drilling fluid 314 may flow through some or all of the jets that are not described as being selectively actuated, for example, to provide cooling and/or cuttings removal from corresponding portions of the downhole tool 300, while the drilling fluid 314 may be caused to flow to a greater or increased degree from the selectively actuated jets to additionally provide the steering effects described herein.

Figure 4:
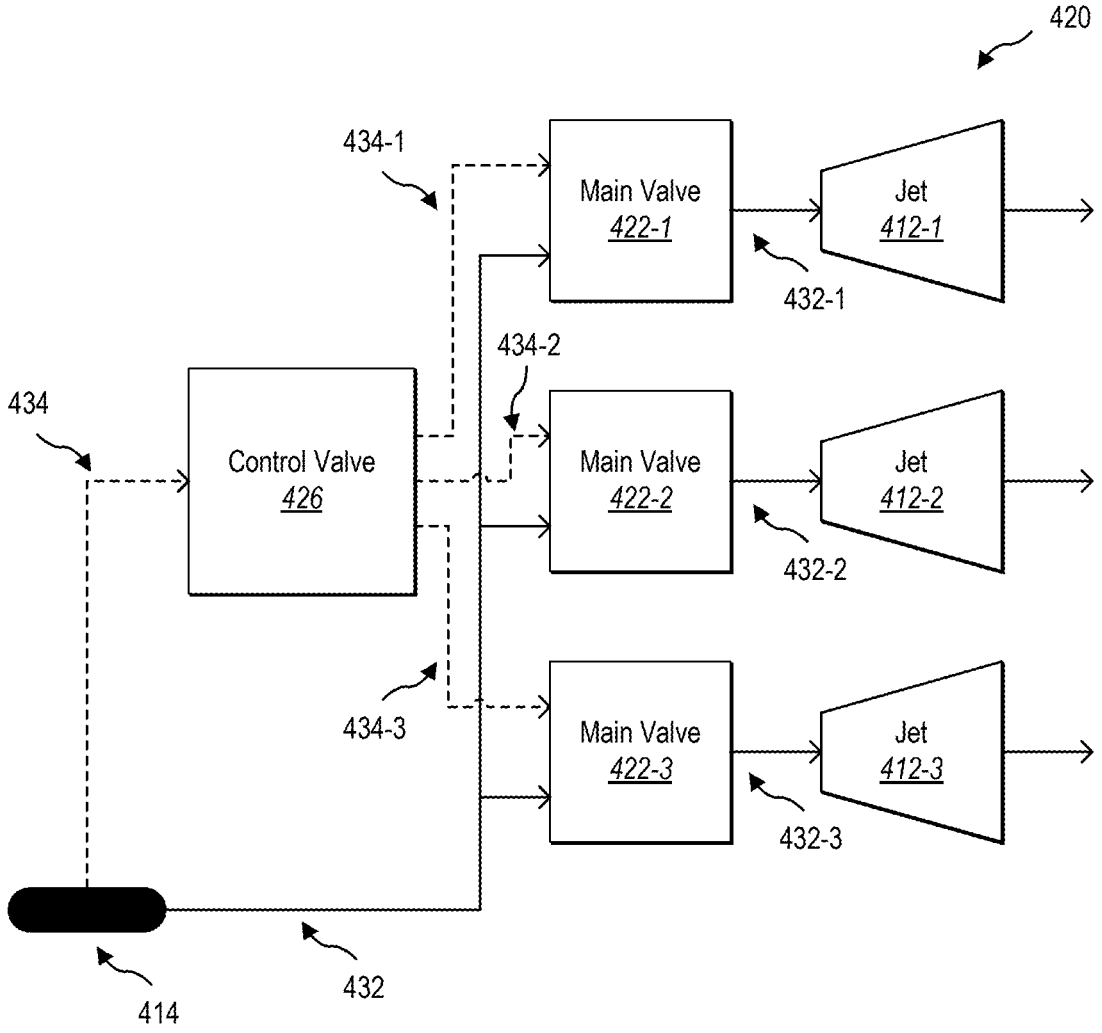
FIG. 4 is a flow diagram of a valve system for selectively directing a flow of drilling fluid, according to at least one embodiment of the present disclosure.

FIG. 4 is a flow diagram of a valve system 420 for selectively directing a flow of drilling fluid, according to at least one embodiment of the present disclosure. The valve system 420 may receive a flow of drilling fluid 414, for example from a flow path of the downhole system traversing an internal bore or hydraulic passage of one or more downhole tools. The valve system 420 includes a control flow path 434 for directing a control flow of the drilling fluid 414 to a control valve 426 and to one or more main valves (collectively 422) to selectively actuate the main valves 422. The valve system 420 includes a main flow path 432 for directing a main flow of the drilling fluid 414 to one or more of the control valves and for directing the main flow to and through corresponding jets (collectively 412).

For example, the control valve 426 may direct the control flow along a first control flow path 434-1 to a first main valve 422-1 to actuate the first main valve 422-1. Based on actuating the first main valve 422-1, the main flow may flow through the first main valve 422-1 along a first main flow path 432-1 to a first jet 412-1. The main flow may flow through the first jet 412-1 for exiting a downhole tool, for example, to steer the downhole tool as described herein. Similarly, the control valve 426 may direct the control flow along a second control flow path 434-2 for actuating a second main valve 422-2 and for causing the main flow to flow along a second main flow path 432-2 to a second jet 412-2. Further, the control valve 426 may direct the control flow along a third control flow path 434-3 for actuating a third main valve 422-3 and for causing the main flow to flow along a third main flow path 432-3 to a third jet 412-3. In this way, the control valve 426 may selectively flow the control flow to any of the main valves 422, including combinations of main valves 422, for flowing the main flow through select jets.

Figure 5:
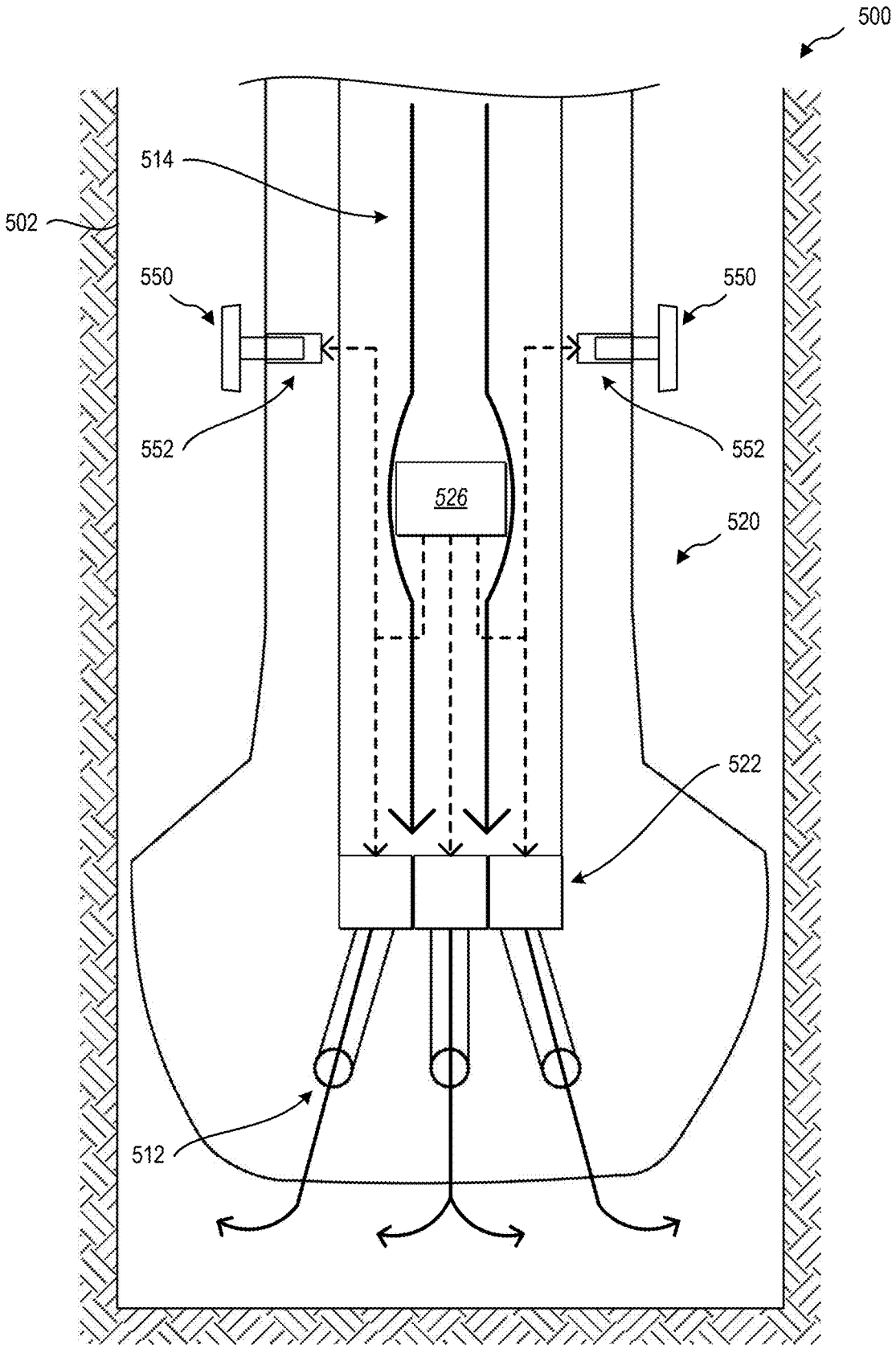
FIG. 5 is a schematic illustration of a downhole tool with a valve system implemented therein for controlling a flow of drilling fluid, according to at least one embodiment of the present disclosure.

FIG. 5 is a schematic illustration of a downhole tool 500 with a valve system 520 implemented therein for controlling a flow of drilling fluid 514, according to at least one embodiment of the present disclosure. Similar to other embodiments described herein, the downhole tool 500 includes a control valve 526 for controlling a plurality of main valves 522 and associated jets 512. The control valve 526 may direct a control flow of the drilling fluid 514 to select main valves 522 in order to selectively flow a main flow of the drilling fluid 514 through the main valves 522 and corresponding jets 512.

In some embodiments, the downhole tool 500 includes one or more engagement elements 550. The engagement elements may be steering elements for directing or steering the downhole tool 500. For instance, the engagement elements 550 may include steering arms or steering pads for engaging with a wall of the wellbore 502 in order to direct the downhole tool 500. The engagement elements 550 may be internal elements for engaging an internal feature of the downhole tool 500 and for directing the downhole tool 500 (e.g., point-the-bit steering system). The engagement elements 550 may be any other engagement feature, such as stabilizer arms or pads.

In some embodiments, the engagement element 550 may be extendible or actuatable. For example, the engagement element 550 may include an engagement assembly for extending, actuating, or otherwise causing the engagement element 550 to engage with a corresponding feature of the downhole tool 500 and/or wellbore 502. In some embodiments, the engagement element 550 is extendable via an engagement actuator 552. The engagement actuator 552 may be any kind of actuator for performing an actuating functionality (e.g., extending the engagement element 550). In some embodiments, the engagement actuator 552 is a hydraulic piston cylinder for extending the engagement element 550. For example, based on a hydraulic fluid (e.g., drilling fluid) received by the engagement actuator 552, the engagement actuator 552 may extend the engagement element 550.

In some embodiments, the control valve 526 may be in fluid communication with the engagement element(s) 550 and/or engagement actuator(s) 552, and may be configured to provide the control flow of the drilling fluid to the engagement actuators(s) 552 to actuate the engagement element(s) 550 in order to steer or direct the downhole tool 500. The steering of the downhole tool 500 in this way may be in addition to the steering effect of flowing the drilling fluid from the jets 512 as described herein. The control valve 526 may be in fluid communication with the engagement actuator(s) 552 (and may be in fluid communication with the control valves 522) in any of a variety of configurations, such as those described herein in connection with FIGS. 6-1 and 6-2.

Figures 1, 6:
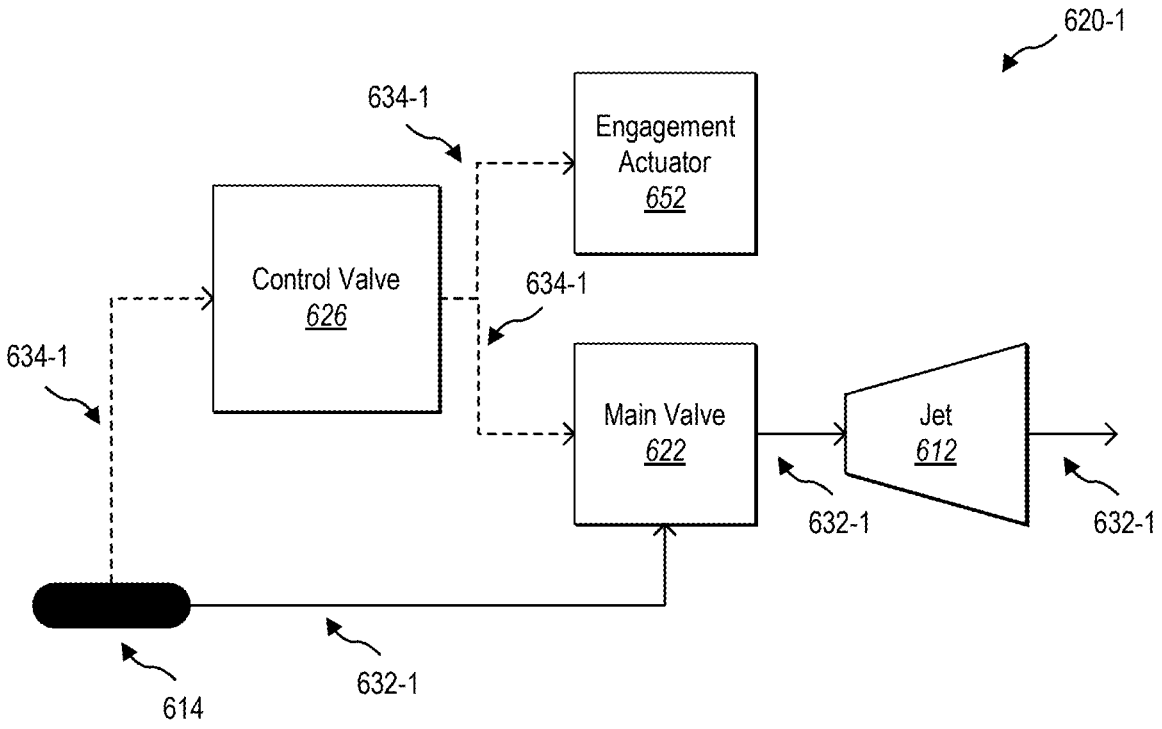
Figures 2, 6:
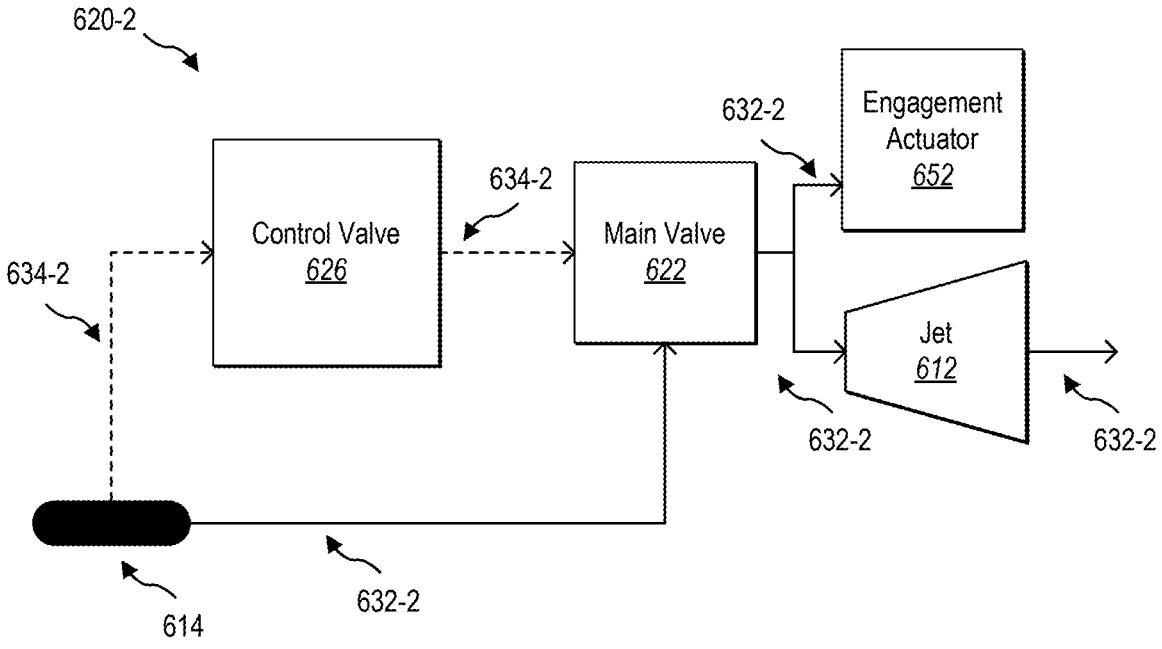

FIG. 6-1 is a flow diagram of a valve system 620-1 for selectively directing a flow of drilling fluid, according to at least one embodiment of the present disclosure. The valve system 620-1 may receive a flow of drilling fluid 614, for example, from a flow path of the downhole system traversing an internal bore or hydraulic passage of one or more downhole tools. The valve system 620-1 includes a control flow path 634-1 for directing a control flow of the drilling fluid 614 to a control valve 626 and to a main valve 622 to selectively actuate the main valve 622. The valve system 620-1 includes a main flow path 632-1 for directing a main flow of the drilling fluid 614 to the main valve 622 and for directing the main flow to and through a corresponding jet 612 (or jets). The valve system 620-1 additionally includes an engagement actuator 652 for actuating an engagement element of a downhole tool. The control valve is in fluid communication with the engagement actuator 652 for actuating the engagement actuator 652 based on directing the control flow to the engagement actuator 652.

In some embodiments, the valve system 620-1 may actuate the engagement actuator 652 in combination with actuating the main valve 622. For example, the engagement actuator 652 and the main valve 622 may be in fluid communication with the control valve 626 along the control flow path 634-1 such that the control valve 626 directs the control flow to both the engagement actuator 652 and the main valve 622 along the control flow path 634-1. For example, as shown, the engagement actuator 652 and the main valve 622 may be positioned in parallel, or on separate, parallel branches of the control flow path 634-1. In other embodiments, the engagement actuator 652 and main valve 622 may be positioned in series along the control flow path 634-1, for example, with either the engagement actuator 652 or the main valve 622 positioned upstream of the other. In this way, as the control valve 626 selectively directs the control flow along the control flow path 634-1, both the engagement actuator 652 and the main valve 622 may be actuated in parallel, for example, for both extending an engagement element and flowing the drilling fluid 614 through the jet 612 in conjunction. As described herein, the actuation of both the engagement actuator 652 and the main valve 622 (and the jet 612) may facilitate steering a downhole tool, for example, based on both the actuation of an engagement element extending and the drilling fluid 614 flowing from the jet 612.

The valve system 620-1 may be implemented with any number of engagement actuators 652 and main valves 622 (and corresponding jets 612), for example, similar to the valve system describe herein in connection with FIG. 4 having multiple main valves. For instance, the valve system 620-1 may include 3 main valves 622 for flowing drilling fluid through 3 jets 612 (or sets of jets 612), and may include 3 corresponding engagement actuators 652. Each engagement actuator 652 may be selectively actuated in conjunction (e.g., in parallel) with a corresponding main valve 622. In some embodiments, multiple engagement actuators 652 may be associated with and actuatable in conjunction with a single main valve 622, such as to deploy several engagement elements in conjunction with flowing the drilling fluid 614 through a specific jet 612 or jets. In this way, the control valve 626 may be implemented to provide multiple control flow outputs, and each control flow output may control a corresponding engagement actuator-main valve set.

FIG. 6-2 is a flow diagram of a valve system 620-2 for selectively directing a flow of drilling fluid, according to at least one embodiment of the present disclosure. The valve system 620-2 may similarly receive a flow of drilling fluid 614. The valve system 620-2 includes a control flow path 634-2 for directing a control flow of the drilling fluid 614 to a control valve 626 and to a main valve 622 to selectively actuate the main valve 622. The valve system 620-2 includes a main flow path 632-2 for directing a main flow of the drilling fluid 614 to the main valve 622 and for directing the main flow to and through a corresponding jet 612 (or jets). The valve system 620-1 additionally includes an engagement actuator 652 for actuating an engagement element of a downhole tool.

In the valve system 620-2, the engagement actuator 652 may be actuated based on the main flow from the main valve 622. For example, as shown, the engagement actuator 652 and the jet 612 may be positioned in parallel, or on separate, parallel branches of the main flow path 632-2. In other examples, the engagement actuator 652 and the jet 612 may be positioned in series along the main flow path 632-2, for example, with either the engagement actuator 652 or the jet 612 upstream of the other. In this way, as the control valve 626 selectively directs the control flow along the control flow path 634-2 and accordingly selectively actuates the main valve 622, the main flow may flow to both the engagement actuator 652 and the jet 612 in parallel. Both the engagement actuator 652 and the jet 612 may be activated in parallel, for example, for both extending an engagement element and flowing the drilling fluid 614 through the jet 612 in conjunction. As described herein, the actuation of both the engagement actuator 652 and the main valve 622 (and the jet 612) may facilitate steering a downhole tool, for example, based on both the actuation of an engagement element and the drilling fluid 614 flowing from the jet 612.

The valve system 620-2 may be implemented with any number of engagement actuators 652 and main valves 622 (and corresponding jets 612), for example, similar to the valve system describe herein in connection with FIG. 4 having multiple main valves. For instance, the valve system 620-2 may include 3 main valves 622 for flowing drilling fluid through 3 jets 612 (or sets of jets 612), and may include 3 corresponding engagement actuators 652. Each engagement actuator 652 may be selectively actuated in conjunction (e.g., in parallel) with a corresponding jet 612. In some embodiments, multiple engagement actuators 652 may be associated with and actuatable based on a single main valve 622 (e.g., in conjunction with a jet 612 or set of jets). For example, based on actuation of a single main valve 622, several engagement elements may be deployed in conjunction with flowing the drilling fluid 614 through a specific jet 612 or jets. In this way, the control valve 626 may be implemented to provide multiple control flow outputs, and each control flow output (e.g., via a corresponding main flow) may control a corresponding engagement actuator-jet set.

Figure 7:
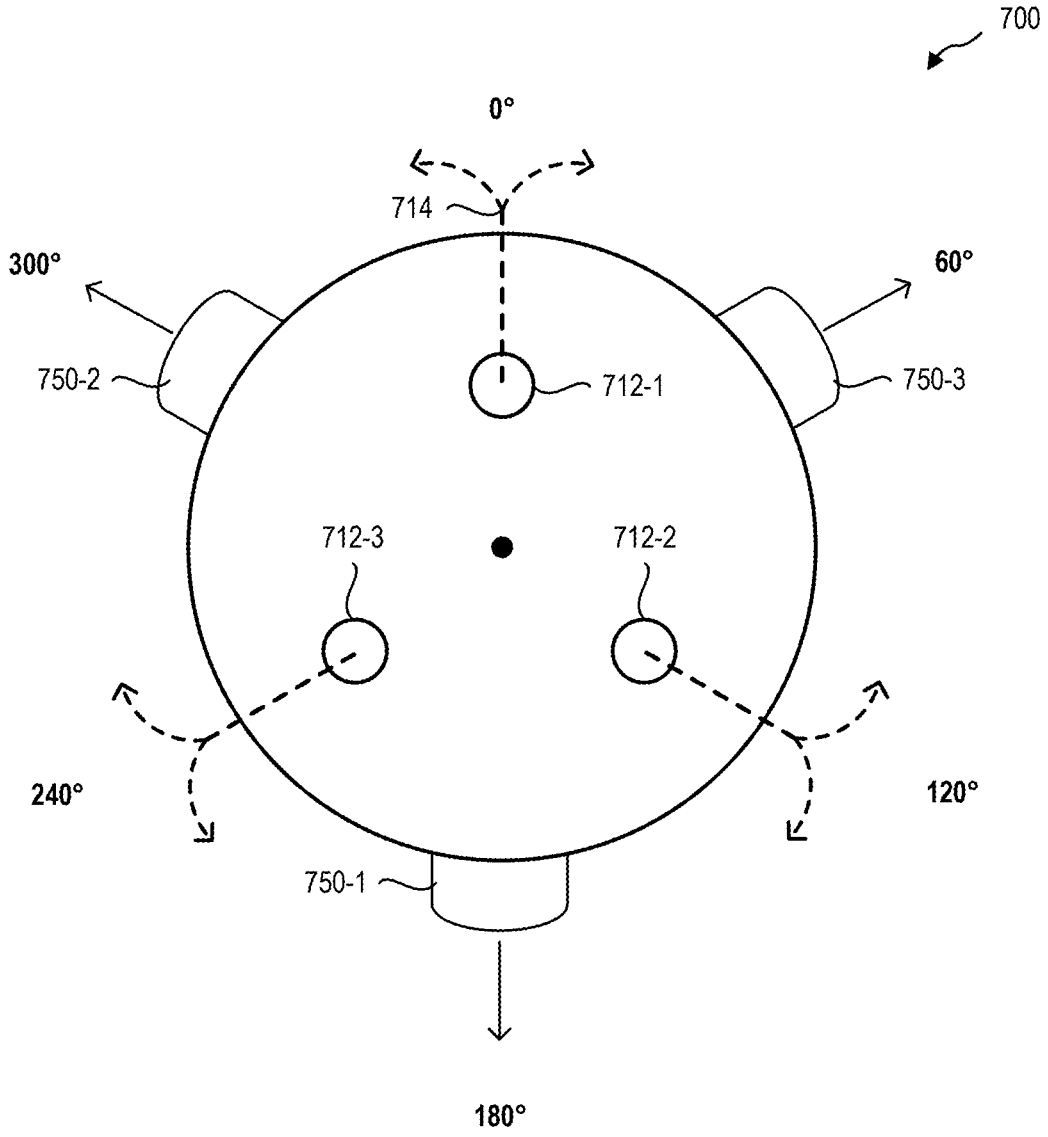
FIG. 7 is a bottom view of a downhole tool having multiple jets and multiple engagement elements, according to at least one embodiment of the present disclosure.

FIG. 7 is a bottom view of downhole tool 700 having multiple jets and multiple engagement elements, according to at least one embodiment of the present disclosure. The downhole tool 700 includes a first jet 712-1, a second jet 712-2, and a third jet 712-3 for selectively flowing a drilling fluid 714 from the jets as described herein. The downhole tool 700 includes a first engagement element 750-1, a second engagement element 750-2, and a third engagement element 750-3 for extending and engaging a wellbore wall to steer the downhole tool 700 as described herein.

In some embodiments, the drilling fluid 714 may be made to selectively flow from select jets in conjunction with select engagement elements being actuated in order to steer the downhole tool 700. For example, based on the drilling fluid 714 flowing out of a given jet and along the downhole tool 700, the downhole tool 700 may be steered in a certain direction, and additionally, a corresponding engagement element may be actuated in combination with the jet as described herein to additionally contribute to the steering of the downhole tool 700 in that direction. For instance, the first jet 712-1 may be associated with and activated in conjunction with the first engagement element 750-1. The first jet 712-1 may be oriented and/or positioned on a body of the downhole tool 700 radially opposite an orientation and/or position of the first engagement element 750-1. For example, the downhole tool 700 may have a substantially round body, and the first jet 712-1 may be positioned on the body at about 0°. The first engagement element 750-1 may accordingly be positioned on the body at about 180°. In this way, as the drilling fluid 714 flows from the first jet 712-1 out of and along the downhole tool around the 0° direction, the downhole tool 700 may be urged or drawn toward the 0° direction. Moreover, the first engagement element 750-1 may extend and engage with the wellbore wall at around the 180° direction to further urge the downhole tool toward the 0° direction. Similarly, the second jet 712-2 may be associated with, and positioned radially opposite the second engagement element 750-2. For example, the second jet 712-2 and the second engagement element 750-2 may be activated in conjunction to steer the downhole tool 700 toward the 120° direction. Further the third jet 712-3 may be associated with and positioned radially opposite the third engagement element 750-3. The third jet 713-3 and the third engagement element 750-3 may be activated in conjunction to steer the downhole tool 700 toward the 300° direction. In this way, the jet(s) and the engagement element(s) of an associated set may be selectively activated in conjunction and may operate together to achieve a steering effect of the downhole tool 700.

In some embodiments, select jets may be associated and activated in conjunction with select engagement elements, but may be otherwise positioned, for example, not radially opposite a corresponding engagement element. For example, in point-the-bit steering scenarios, a corresponding engagement element-jet set may be implemented on a same side or in a same direction in order to achieve steering of the downhole tool as described herein.

The following description includes various embodiments that, where feasible, may be combined in any permutation. For example, the embodiment disclosed in the next paragraph may be combined with any or all embodiments of the paragraphs that follow. Embodiments that describe acts of a method may be combined with embodiments that describe, for example, systems and/or devices. Any permutation of the following paragraphs is considered to be hereby disclosed for the purposes of providing "unambiguously derivable support" for any claim amendment based on the following paragraphs. Furthermore, the following paragraphs provide support such that any combination of the following paragraphs would not create an "intermediate generalization."

In some embodiments, a downhole tool for forming a wellbore includes a plurality of jets configured to flow a main flow of a flow of drilling fluid out of the downhole tool along a plurality of main flow paths of the main flow, a plurality of main valves in fluid communication with the plurality of jets along the plurality of main flow paths and being actuatable to control the main flow through the plurality of jets, wherein the plurality of main valves is actuatable based on a control flow of the flow of drilling fluid, the plurality of main valves corresponding to at least one jet of the plurality of jets, a control valve in fluid communication with the plurality of main valves along a plurality of control flow paths of the control flow and configured to direct the control flow selectively to the plurality of main valves to selectively actuate the plurality of main valves based on a selective mechanical input to the control valve, and a mechanical input mechanism for providing the selective mechanical input to the control valve.

In some embodiments, the control valve is a rotary valve and/or the selective mechanical input to the control valve is a selective rotation of a rotor of the rotary valve.

In some embodiments, the mechanical input mechanism is a roll-stabilize platform of the downhole tool coupled to the rotor of the rotary valve to selectively rotate the rotor.

In some embodiments, the mechanical input mechanism is a motor coupled to the rotor of the rotary valve to selectively rotate the rotor with respect to the downhole tool.

In some embodiments, the plurality of main valves are shuttle valves.

In some embodiments, the plurality of jets is positioned at a downhole end of the downhole tool and wherein a selective flowing of the main flow through the plurality of jets is configured to adjust a direction of the downhole tool based on differential flow dynamics of the main flow at an outer portion of the downhole tool.

In some embodiments, the main flow and the control flow exhibit a same fluid pressure within the downhole tool.

In some embodiments, the mechanical input mechanism is configured to provide the selective mechanical input to the control valve based on a fluid pressure of the control flow of up to 1000 psi acting on the control valve.

In some embodiments, the main flow has a flow rate that is at least 10 times a flowrate of the control flow.

In some embodiments, the control valve is not positioned on the plurality of main flow paths and is not in fluid communication with the main flow.

In some embodiments, a downhole tool for forming a wellbore includes one or more jets configured to flow a main flow of a flow of drilling fluid out of the downhole tool along a main flow path of the main flow, a main valve in fluid communication with the one or more jets along the main flow path and being actuatable to control the main flow through the one or more jets, wherein the main valve is actuatable based on a control flow of the flow of drilling fluid, an engagement actuator being actuatable based on the control flow to adjust a direction of the downhole tool, a control valve in fluid communication with the main valve and the engagement actuator along a control flow path of the control flow and configured to direct the control flow to the main valve and to the engagement actuator to actuate the main valve and the engagement actuator based on a mechanical input to the control valve, and a mechanical input mechanism for providing the mechanical input to the control valve.

In some embodiments, the engagement actuator is positioned in parallel with the main valve on the control flow path.

In some embodiments, the engagement actuator is positioned and configured on the downhole tool such that an actuation of the engagement actuator adjusts the direction of the downhole tool in a first direction, and/or wherein the one or more jets are positioned and configured on the downhole tool such that the main flow through the one or more jets adjusts the direction of the downhole tool in the first direction.

In some embodiments, the one or more jets are positioned at a downhole end of the downhole tool and the engagement actuator is positioned on a body of the downhole tool, and/or wherein the engagement actuator is positioned substantially radially opposite at least one of the one or more jets.

In some embodiments, the one or more jets includes a first jet and a second jet, the main valve is a first main valve in fluid communication with the first jet along a first main flow path, and the engagement actuator is a first engagement actuator. In some embodiments, the downhole tool further includes a second main valve in fluid communication with the second jet along a second main flow path, and a second engagement actuator. In some embodiments, the control valve is in fluid communication with the first main valve and the first engagement actuator along a first control flow path of the control flow, the control valve is in fluid communication with the second main valve and the second engagement actuator along a second control flow path of the control flow. In some embodiments, the control valve is configured to direct the control flow selectively along the first control flow path or the second control flow path to selectively actuate the first main valve and the first engagement actuator or to selectively actuate the second main valve and the second engagement actuator, based on the mechanical input.

In some embodiments, a downhole tool for forming a wellbore includes one or more jets configured to flow a main flow of a flow of drilling fluid out of the downhole tool along a main flow path of the main flow, an engagement actuator being actuatable based on the main flow to adjust a direction of the downhole tool, a main valve in fluid communication with the one or more jets and with the engagement actuator along the main flow path and being actuatable to control the main flow to the engagement actuator and to the one or more jets, wherein the main valve is actuatable based on a control flow of the flow of drilling fluid, a control valve in fluid communication with the main valve along a control flow path of the control flow and configured to direct the control flow to the main valve to actuate the main valve based on a mechanical input to the control valve, and a mechanical input mechanism for providing the mechanical input to the control valve.

In some embodiments, the engagement actuator is positioned in parallel with the one or more jets on the main flow path.

In some embodiments, the engagement actuator is positioned and configured on the downhole tool such that an actuation of the engagement actuator adjusts the direction of the downhole tool in a first direction, and/or wherein the one or more jets are positioned and configured on the downhole tool such that the main flow through the one or more jets adjusts the direction of the downhole tool in the first direction.

In some embodiments, the one or more jets are positioned at a downhole end of the downhole tool and the engagement actuator is positioned on a body of the downhole tool, and/or wherein the engagement actuator is positioned substantially radially opposite at least one of the one or more jets.

In some embodiments, the one or more jets includes a first jet and a second jet, the engagement actuator is a first engagement actuator being actuatable based on the main flow, and the main valve is a first main valve in fluid communication with the first jet and the first engagement actuator along a first main flow path and being actuatable to control the main flow to the first jet and to the first engagement actuator. In some embodiments, the downhole tool further includes a second engagement actuator being actuatable based on the main flow, and a second main valve in fluid communication with the second jet and the second engagement actuator along a second main flow path and being actuatable to control the main flow to the second jet and the second engagement actuator. In some embodiments, the control valve is in fluid communication with the first main valve along a first control flow path of the control flow, the control valve is in fluid communication with the second main valve along a second control flow path of the control flow, and the control valve is configured to direct the control flow selectively along the first control flow path or the second control flow path to selectively actuate the first main valve or the second main valve based on the mechanical input.

The embodiments of the valve systems have been primarily described with reference to wellbore drilling operations; the valve systems described herein may be used in applications other than the drilling of a wellbore. In other embodiments, the valve systems according to the present disclosure may be used outside a wellbore or other downhole environment used for the exploration or production of natural resources. For instance, the valve systems of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements. Additionally, as used herein, the term "and/or" includes any and all combinations of one or more of the associated listed items.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A downhole tool for forming a wellbore, comprising:

a plurality of jets configured to flow a main flow of a flow of drilling fluid out of the downhole tool along a plurality of main flow paths of the main flow;

a plurality of main valves in fluid communication with the plurality of jets along the plurality of main flow paths and being actuatable to control the main flow through the plurality of jets, wherein the plurality of main valves is actuatable based on a control flow of the flow of drilling fluid, wherein the plurality of main valves corresponds to the plurality of jets;

a control valve in fluid communication with the plurality of main valves along a plurality of control flow paths of the control flow and configured to direct the control flow selectively to the plurality of main valves to selectively actuate the plurality of main valves based on a selective mechanical input to the control valve; and a mechanical input mechanism for providing the selective mechanical input to the control valve.

2. The downhole tool of claim 1, wherein the control valve is a rotary valve and/or the selective mechanical input to the control valve is a selective rotation of a rotor of the rotary valve.

3. The downhole tool of claim 2, wherein the mechanical input mechanism is a roll-stabilize platform of the downhole tool coupled to the rotor of the rotary valve to selectively rotate the rotor.

4. The downhole tool of claim 2, wherein the mechanical input mechanism is a motor coupled to the rotor of the rotary valve to selectively rotate the rotor with respect to the downhole tool.

5. The downhole tool of claim 1, wherein the plurality of main valves are shuttle valves.

6. The downhole tool of claim 1, wherein the plurality of jets are positioned at a downhole end of the downhole tool and wherein a selective flowing of the main flow through the plurality of jets is configured to adjust a direction of the downhole tool based on differential flow dynamics of the main flow at an outer portion of the downhole tool.

7. The downhole tool of claim 1, wherein the main flow and the control flow exhibit a same fluid pressure within the downhole tool.

8. The downhole tool of claim 1, wherein the mechanical input mechanism is configured to provide the selective mechanical input to the control valve based on a fluid pressure of the control flow of up to 1000 psi acting on the control valve.

9. The downhole tool of claim 1, wherein the main flow has a flow rate that is at least 10 times a flowrate of the control flow.

10. The downhole tool of claim 1, wherein the control valve is not positioned on the plurality of main flow paths and is not in fluid communication with the main flow.

11. A downhole tool for forming a wellbore, comprising:

one or more jets configured to flow a main flow of a flow of drilling fluid out of the downhole tool along a main flow path of the main flow;

a main valve in fluid communication with the one or more jets along the main flow path and being actuatable to control the main flow through the one or more jets, wherein the main valve is actuatable based on a control flow of the flow of drilling fluid;

an engagement actuator being actuatable based on the control flow to adjust a direction of the downhole tool;

a control valve in fluid communication with the main valve and the engagement actuator along a control flow path of the control flow and configured to direct the control flow to the main valve and to the engagement actuator to actuate the main valve and the engagement actuator based on a mechanical input to the control valve; and a mechanical input mechanism for providing the mechanical input to the control valve.

12. The downhole tool of claim 11, wherein the engagement actuator is positioned in parallel with the main valve on the control flow path.

13. The downhole tool of claim 11, wherein the engagement actuator is positioned and configured on the downhole tool such that an actuation of the engagement actuator adjusts the direction of the downhole tool in a first direction, and/or wherein the one or more jets are positioned and configured on the downhole tool such that the main flow through the one or more jets adjusts the direction of the downhole tool in the first direction.

14. The downhole tool of claim 13, wherein the one or more jets are positioned at a downhole end of the downhole tool and the engagement actuator is positioned on a body of the downhole tool, and/or wherein the engagement actuator is positioned substantially radially opposite at least one of the one or more jets.

15. The downhole tool of claim 11, wherein:

the one or more jets includes a first jet and a second jet;

the main valve is a first main valve in fluid communication with the first jet along a first main flow path;

the engagement actuator is a first engagement actuator;

the downhole tool further includes:

a second main valve in fluid communication with the second jet along a second main flow path; and a second engagement actuator;

the control valve is in fluid communication with the first main valve and the first engagement actuator along a first control flow path of the control flow;

the control valve is in fluid communication with the second main valve and the second engagement actuator along a second control flow path of the control flow; and the control valve is configured to direct the control flow selectively along the first control flow path or the second control flow path to selectively actuate the first main valve and the first engagement actuator or to selectively actuate the second main valve and the second engagement actuator, based on the mechanical input.

16. A downhole tool for forming a wellbore, comprising:

one or more jets configured to flow a main flow of a flow of drilling fluid out of the downhole tool along a main flow path of the main flow;

an engagement actuator being actuatable based on the main flow to adjust a direction of the downhole tool;

a main valve in fluid communication with the one or more jets and with the engagement actuator along the main flow path and being actuatable to control the main flow to the engagement actuator and to the one or more jets, wherein the main valve is actuatable based on a control flow of the flow of drilling fluid;

a control valve in fluid communication with the main valve along a control flow path of the control flow and configured to direct the control flow to the main valve to actuate the main valve based on a mechanical input to the control valve; and a mechanical input mechanism for providing the mechanical input to the control valve.

17. The downhole tool of claim 16, wherein the engagement actuator is positioned in parallel with the one or more jets on the main flow path.

18. The downhole tool of claim 16, wherein the engagement actuator is positioned and configured on the downhole tool such that an actuation of the engagement actuator adjusts the direction of the downhole tool in a first direction, and/or wherein the one or more jets are positioned and configured on the downhole tool such that the main flow through the one or more jets adjusts the direction of the downhole tool in the first direction.

19. The downhole tool of claim 18, wherein the one or more jets are positioned at a downhole end of the downhole tool and the engagement actuator is positioned on a body of the downhole tool, and/or wherein the engagement actuator is positioned substantially radially opposite at least one of the one or more jets.

20. The downhole tool of claim 16, wherein:

the one or more jets includes a first jet and a second jet;

the engagement actuator is a first engagement actuator being actuatable based on the main flow;

the main valve is a first main valve in fluid communication with the first jet and the first engagement actuator along a first main flow path and being actuatable to control the main flow to the first jet and to the first engagement actuator;

the downhole tool further includes:

a second engagement actuator being actuatable based on the main flow;

and a second main valve in fluid communication with the second jet and the second engagement actuator along a second main flow path and being actuatable to control the main flow to the second jet and the second engagement actuator;

the control valve is in fluid communication with the first main valve along a first control flow path of the control flow;

the control valve is in fluid communication with the second main valve along a second control flow path of the control flow; and the control valve is configured to direct the control flow selectively along the first control flow path or the second control flow path to selectively actuate the first main valve or the second main valve based on the mechanical input.

* * * * *